US006786675B1

(12) United States Patent
Detiveaux

(10) Patent No.: US 6,786,675 B1
(45) Date of Patent: Sep. 7, 2004

(54) EROSION CONTROL AND BULKHEAD APPARATUS

(76) Inventor: Carl T. Detiveaux, P.O. Box 3157, Houma, LA (US) 70361

( * ) Notice: Subject to any disclaimer, the term of this patent is extended or adjusted under 35 U.S.C. 154(b) by 0 days.

(21) Appl. No.: 10/438,274

(22) Filed: May 14, 2003

Related U.S. Application Data

(63) Continuation-in-part of application No. 10/106,809, filed on Mar. 26, 2002, which is a continuation-in-part of application No. 09/426,206, filed on Oct. 25, 1999, now Pat. No. 6,361,247.

(51) Int. Cl.[7] ..... E02B 3/06

(52) U.S. Cl. ..... 405/21; 405/30; 405/275; 405/286

(58) Field of Search ..... 405/15, 21, 25, 405/30–35, 274, 275, 284, 286, 302.6, 302

(56) References Cited

U.S. PATENT DOCUMENTS

| | | | | |
|---|---|---|---|---|
| 315,384 | A | 4/1885 | Boynton | |
| 346,140 | A | 7/1886 | Bates | |
| 1,467,470 | A | 9/1923 | Borg | |
| 3,733,831 | A | 5/1973 | Sticker, Jr. | |
| 3,927,533 | A * | 12/1975 | Hebel, Jr. | 405/25 |
| 4,047,389 | A | 9/1977 | Yang | |
| 4,130,994 | A | 12/1978 | Van Moss, Jr. | |
| 4,498,805 | A | 2/1985 | Weir | |
| 4,502,816 | A | 3/1985 | Creter, Jr. et al. | |
| 4,711,598 | A | 12/1987 | Schaaf et al. | |
| 4,715,744 | A | 12/1987 | Richey | |
| 4,767,235 | A | 8/1988 | Caradonna et al. | |
| 4,790,685 | A | 12/1988 | Scott et al. | |
| 4,877,349 | A | 10/1989 | Greene | |
| 4,913,595 | A | 4/1990 | Creter, Jr. et al. | |
| 4,978,247 | A | 12/1990 | Lenson | |
| 5,102,257 | A | 4/1992 | Creter | |
| 5,120,156 | A | 6/1992 | Rauch | |
| 5,123,780 | A | 6/1992 | Martinsen | |
| 5,178,489 | A | 1/1993 | Suhayda | |
| 5,246,307 | A | 9/1993 | Rauch | |
| 5,259,696 | A | 11/1993 | Beardsley | |
| 5,393,169 | A | 2/1995 | Creter | |
| 5,441,362 | A | 8/1995 | Melby et al. | |
| 5,443,326 | A | 8/1995 | Bernard et al. | |
| 5,507,594 | A | 4/1996 | Speicher | |
| 5,536,111 | A | 7/1996 | Doernemann | |
| 5,536,112 | A | 7/1996 | Oertel, II | |
| 6,048,139 | A | 4/2000 | Donovan, II | |
| 6,102,616 | A | 8/2000 | Foote | |
| 6,305,877 | B1 * | 10/2001 | Cavanagh | 405/26 |
| 6,361,247 | B1 | 3/2002 | Detiveaux | |
| 6,663,321 | B1 * | 12/2003 | Bisschops | 405/232 |

* cited by examiner

*Primary Examiner*—Robert E. Pezzuto
*Assistant Examiner*—Alexandra K. Pechhold
(74) *Attorney, Agent, or Firm*—Garvey, Smith, Nehrbass & Doody, L.L.C.; Charles C. Garvey, Jr.

(57) ABSTRACT

An erosion control method and apparatus provides multiple concrete bodies for erosion control that each include tubular hollow bore sections. Each section has front and rear openings that communicate with the hollow bore. Each body is an elongated tapered pile-like member. The plurality of the concrete bodies can be installed side by side using a jetting pump that preferably occupies the bore, and with tongue and groove connections interlocking the bodies upon assembly. A plurality of the concrete bodies can be placed side by side to form a bulkhead or breakwater to protect a shoreline, bank, island or the like.

11 Claims, 16 Drawing Sheets

EROSION CONTROL AND BULKHEAD APPARATUS

CROSS-REFERENCE TO RELATED APPLICATIONS

This is a continuation-in-part of copending U.S. patent application Ser. No. 10/106,809 filed Mar. 26, 2002, which is a continuation-in-part of U.S. patent application Ser. No. 09/426,206, filed Oct. 25, 1999, now U.S. Pat. No. 6,361, 247, issued Mar. 26, 2002, both entitled "Erosion Control and Bulkhead Apparatus", which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to erosion control and bulkhead systems designed to protect shorelines and to encourage the retention of accretions in order to help build new shorelines. More particularly, the present invention relates to an improved erosion control system and breakwater apparatus that features individual precast concrete members having a tubular body section, and an open ended vertical bore that receives sediment carried by waves via front and rear openings.

2. General Background of the Invention

The loss of shoreline is a chronic problem in many coastal areas. Wave action can destroy shorelines and adjacent homes or building especially during storm conditions.

One of the often suggested solutions to the problem of coastal erosion control has been the formation of a bulkhead or breakwater in the suspect area.

Bulkheads can take from of elongated networks of pilings, either round or sheet pile type construction. Various systems have been patented that relate generally to erosion control. The following list of patents are examples of systems that are used for bulkheading and/or erosion control at shorelines:

| U.S. Pat. No. | Title |
|---|---|
| 6,361,247 | Erosion Control and Bulkhead Apparatus |
| 6,102,616 | Wave Break |
| 5,536,112 | Breakwater Generating Apparatus and Process for Controlling Coastal Erosion |
| 5,507,594 | Method and Apparatus for Constructing an Artificial Reef |
| 5,441,362 | Concrete Armor Unit for Protecting Coastal and Hydraulic Structures and Shorelines |
| 5,393,169 | Breakwater |
| 5,259,696 | Means for and Method of Beach Rebuilding and Erosion Control |
| 5,246,307 | Submerged Breakwater and Barrier Reef |
| 5,178,489 | Hydrodynamic Control System |
| 5,123,780 | Precast Permeable Breakwater Unit |
| 5,120,156 | Submerged Breakwater and Barrier Reef |
| 5,102,257 | Breakwater |
| 4,978,247 | Erosion |
| 4,913,595 | Shoreline Breakwater |

-continued

| U.S. Pat. No. | Title |
|---|---|
| 4,790,685 | Shoreline Breakwater for Coastal Waters |
| 4,767,235 | Prefabricated Composite Element for Building of a Sea Wall |
| 4,715,744 | Floating Breakwater |
| 4,502,816 | Shoreline Breakwater |
| 4,498,805 | Breakwater Module and Means for Protecting a Shoreline Therewith |
| 4,130,994 | Artificial Reef to Prevent Shoreline Erosion |
| 4,047,389 | Precast Concrete Pile, and Cofferdams |
| 3,733,831 | Method and apparatus for Preventing Erosion and for Conveying |
| 1,467,470 | Concrete Bulkhead or Retaining Wall |
| 346,140 | Breakwater |
| 315,384 | Jetty, Breakwater, or Similar Structure |

BRIEF SUMMARY OF THE INVENTION

The present invention provides an improved breakwater apparatus for protecting and building a shoreline of a body of water or an island shoreline. The apparatus includes a concrete body or a plurality of bodies, each having upper and lower end portions. Each concrete body is of a tubular shape with a sidewall or walls and provides front and rear surfaces with flow openings.

A vertical bore is preferably open ended and extends between the upper and lower end portions of the body. Inlet and outlet openings define flow intake and flow discharge openings that communicate with the vertical bore portion of the concrete body. The tubular bodies can be jetted into position using a pump that lowers each concrete body into a marine sea bed or water bottom.

The apparatus includes preferably a plurality of concrete bodies that extend laterally along any shoreline or bank to be protected. The concrete body includes a front breakwater opening that extends through the concrete body at its front and a rear breakwater opening at its rear.

The present invention provides a method of erosion control for controlling erosion at a shoreline next to a sea bed and for accumulating accretions that help build shoreline. The method includes the placing of a network of tubular concrete bodies along a shoreline to be protected. Each concrete body provides an internal open ended vertical bore.

The method includes the jetting of each of the concrete bodies into a partially embedded position that places a lower end portion of each concrete body in the sea bed using a pump that is lowered into the vertical bore of each tubular body. A plurality of the concrete bodies are closely positioned one adjacent another to form a wall or breakwater.

DETAILED DESCRIPTION OF THE PREFERRED EMBODIMENT

Figure 6:
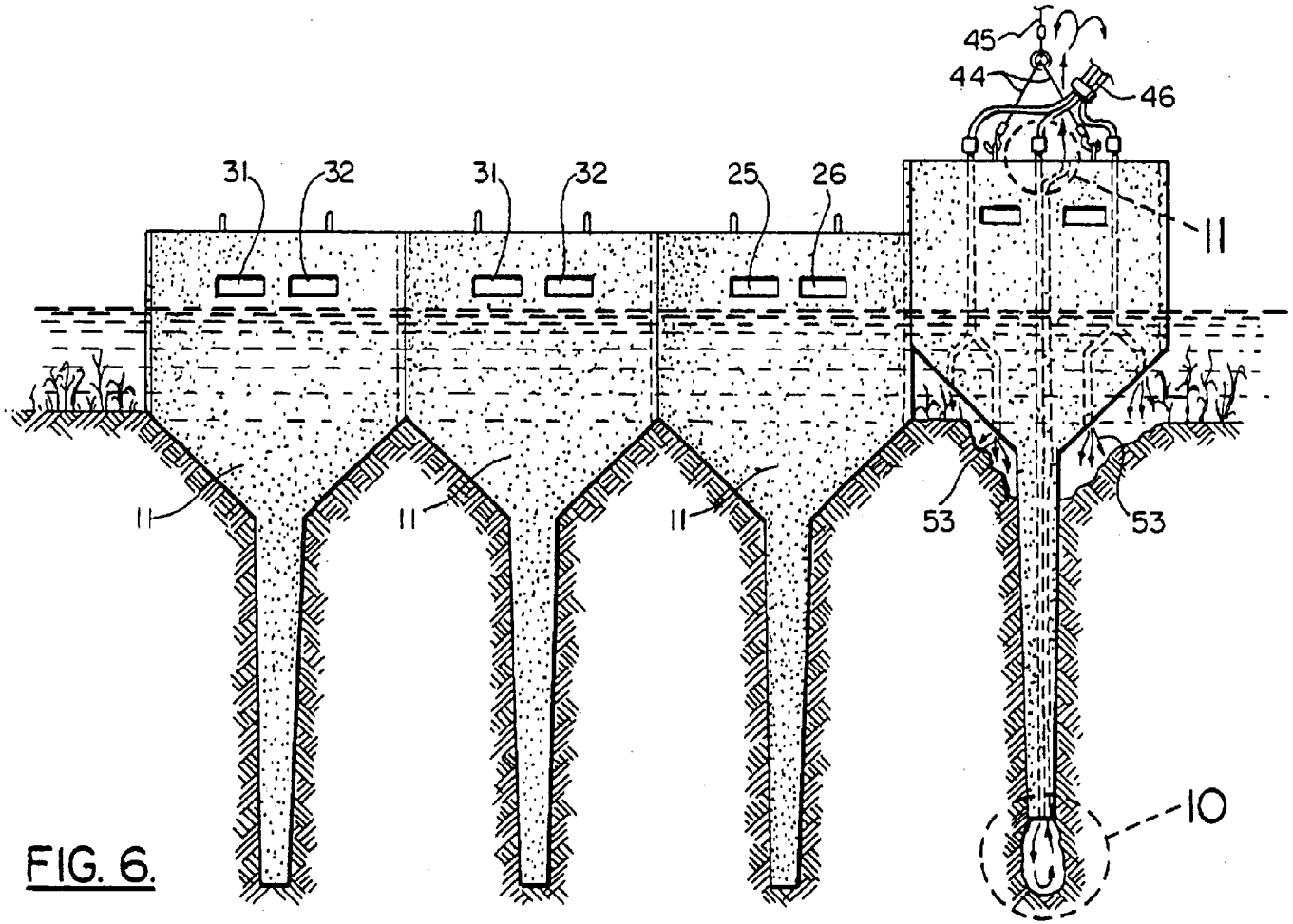
FIG. 6 is an elevation view illustrating the method of installation of the present invention.
Figure 8:
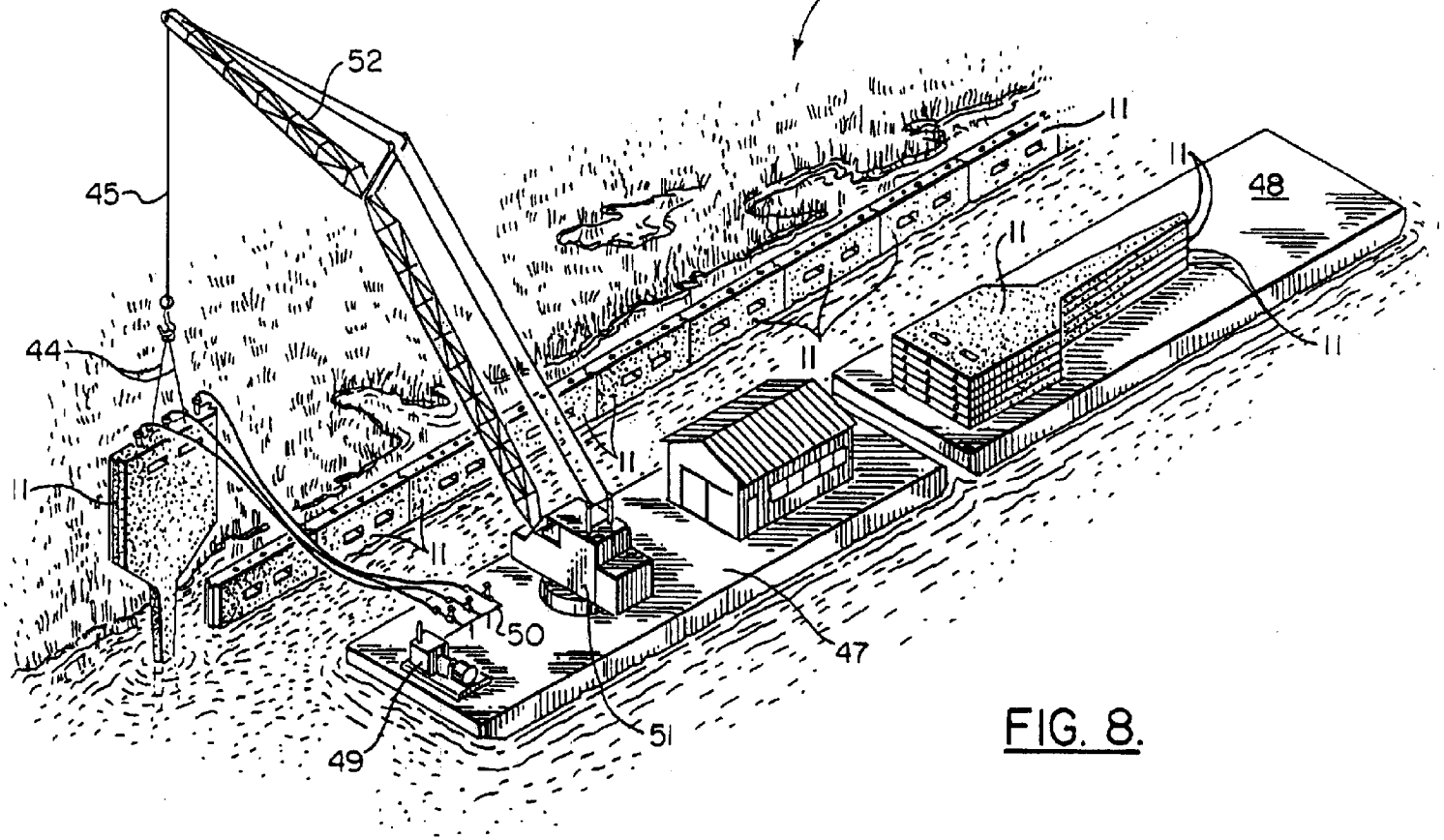
FIG. 8 is perspective view illustrating installation of the apparatus of the present invention using a derrick barge positioned near a shoreline.

Erosion control apparatus 10 is shown generally in FIGS. 6 and 8. The apparatus 10 can be in the form of one or more concrete bodies 11 that are typically placed next to a shoreline to be protected. Concrete body 11 can include three integrally formed sections. These sections 12–14 include a lower pile-like section 12 that can be cylindrical or rectangular in transverse cross section (and preferably tapered), a middle transition section 13 and an upper generally rectangular section 14. Reference line 74 in FIG. 6A separates middle transition section 13 from upper section 14. Reference line 75 in FIG. 6A separates middle transition section 13 from lower section 12. The lower section 12 can be tapered to include angled sidewalls 15, 16. The middle transition section can provide diagonally extending sidewalls 18, 19. The concrete body 11 provides a bottom surface 17 at the lower end of lower tapered section 12 and a flat upper surface 24 at the top of upper rectangular section 14. The upper rectangular section 14 includes generally vertical sidewalls 20 and 21.

Figure 6A:
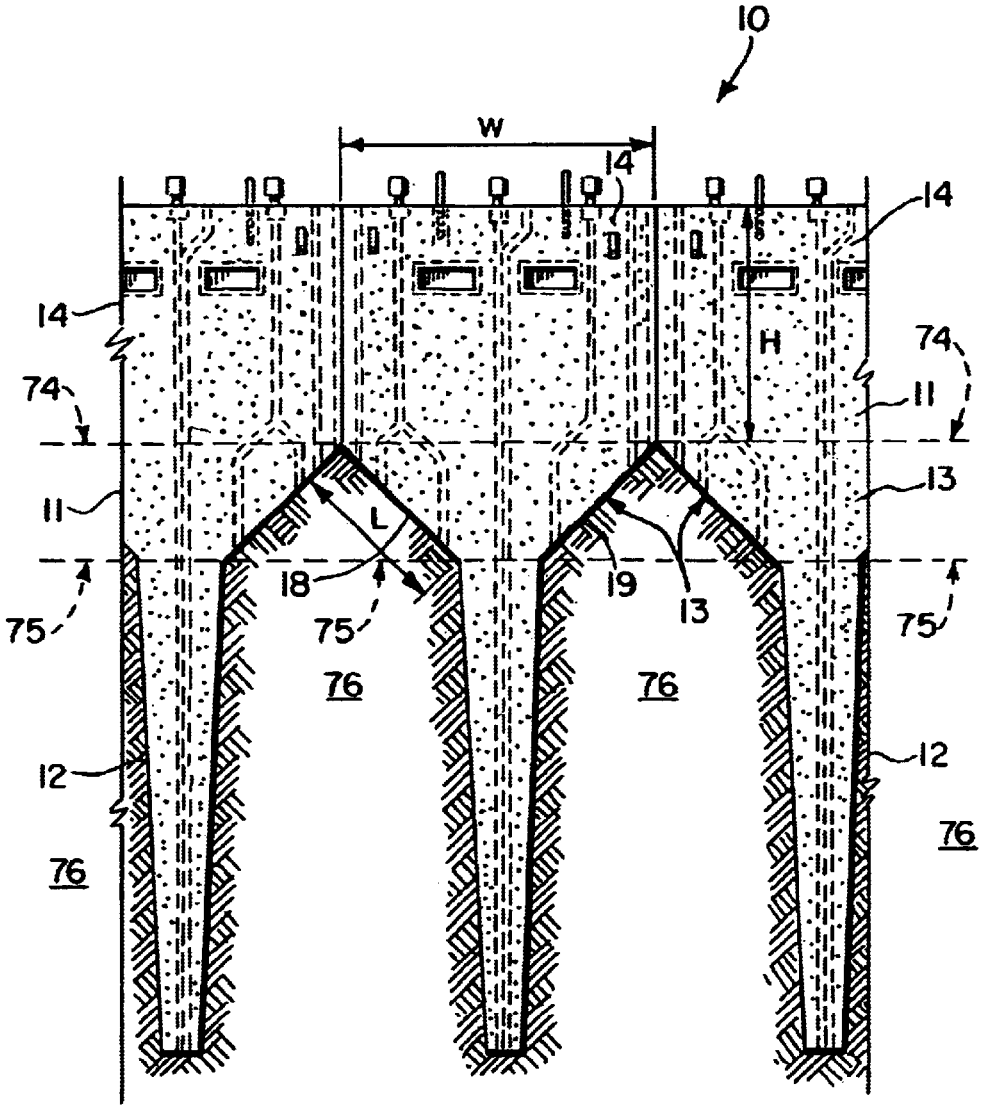
FIG. 6A is an elevation view of the preferred embodiment of the apparatus of the present invention showing the geometry, configuration and placement of a few of the concrete bodies used in the method of the present invention.
Figure 7C:
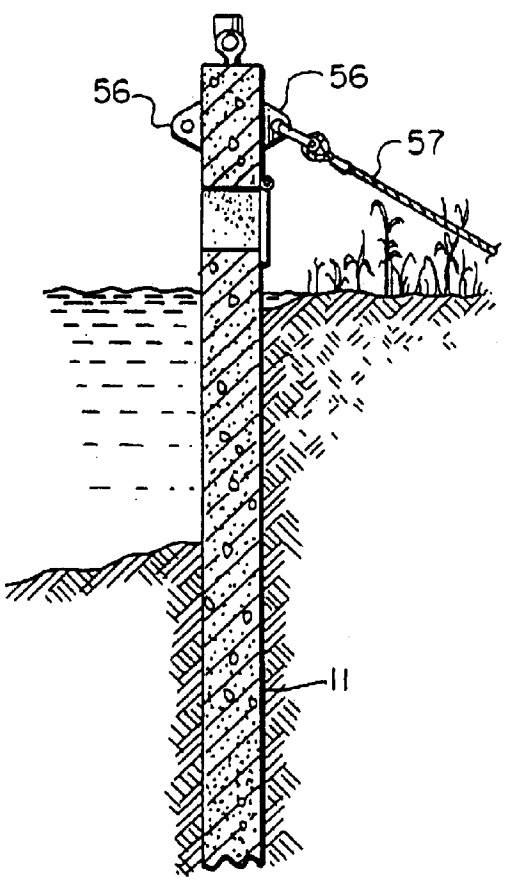
FIGS. 7A, 7B and 7C show the apparatus of the present invention during use and over time during reformation of new shoreline.
Figure 7B:
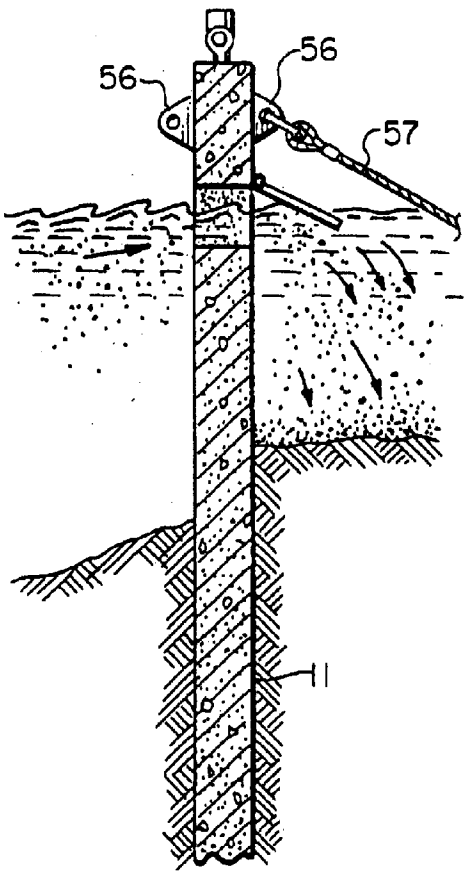
Figure 7A:
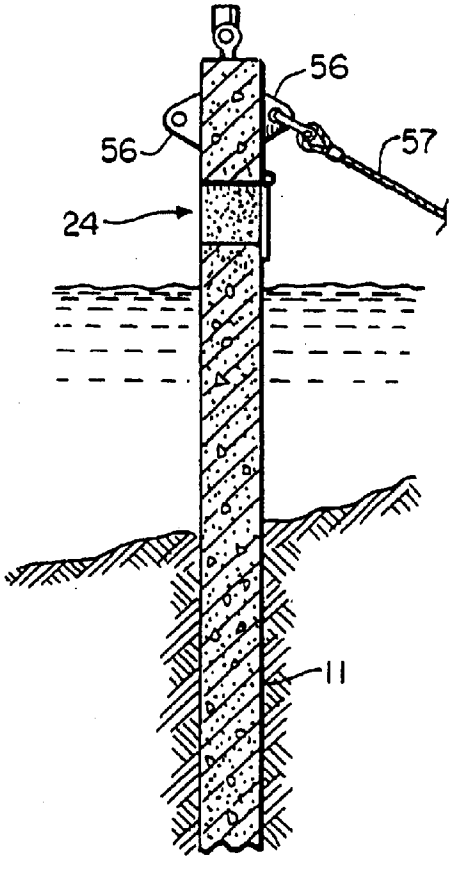
Figure 14:
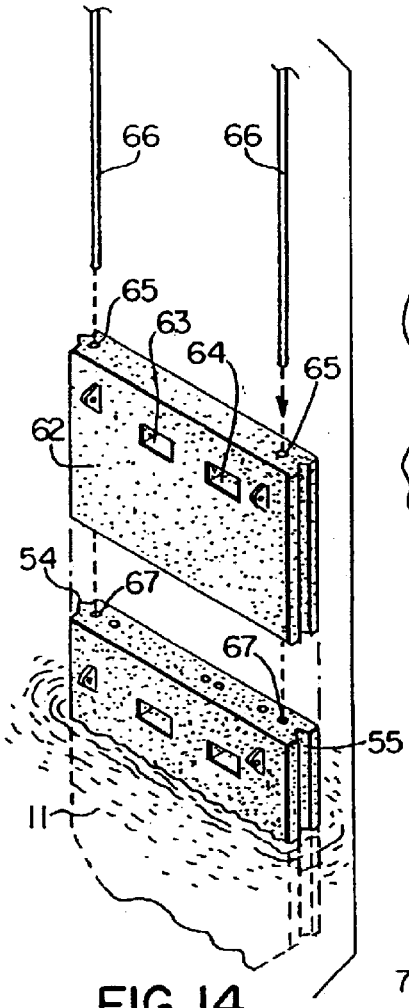
FIG. 14 is a perspective view of a second embodiment of the apparatus of the present invention.

Each concrete body 11 has a generally flat front surface 22 and a generally flat rear surface 23. A plurality of openings 25, 26 extend through concrete body 11, each opening 25, 26 communicate between surfaces 22, 23. Each opening 25, 26 is valved with valve plate 27 that can be pivotally attached at hinge 28 to rear surface 23 of body 11 using hinge 28. In FIG. 14, correction 4, arrow 29 indicates schematically the pivotal movement of valve plate 27 or hinge 28 with respect to body 11 during use. In FIG. 6A, the geometry, configuration and installed position of a concrete body 11 can be seen. In FIG. 6A, the transition section 13 has inclined walls or surfaces 18–19, each of length L. The upper section 14 is preferably generally square or rectangular, having a width W and a height H. Width W is preferably about equal to or greater than height H. The width W can be much wider than the height H. Width W can be less than height W, but not less than one half the height H. The height H is preferably not more than twice the dimension of the width so that a broad surface area extends above seabed 39 to face incoming waves, maximizing the area that receives wave action per each concrete body to provide erosion control.

In order to present a large surface area to incoming wave action, only the lower 12 and transition 13 sections are imbedded in the soil and/or sand 76 mass below seabed 39. A majority and preferably all of upper section 14 extends above seabed 39 during use.

Figure 9A:
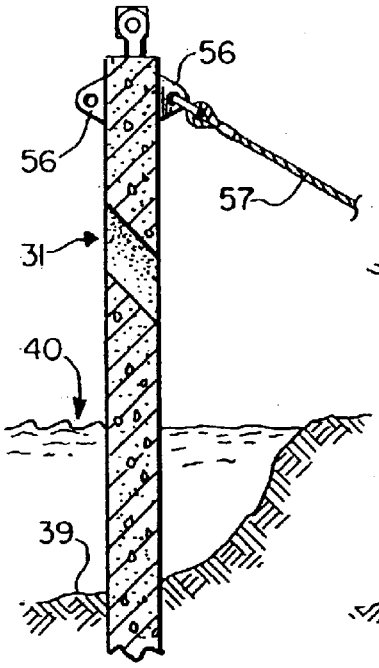
FIGS. 9A and 9B are fragmentary side views that illustrate the openings that communicate between the front surface and the rear surface of a concrete body.
Figure 9B:
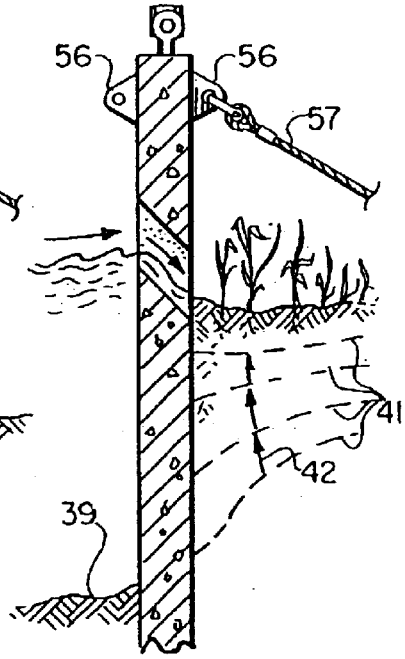

Each concrete body 11 can be lifted during installation using a crane 51 (see FIG. 8) or like lifting apparatus. One or more lifting eyes 30 can be provided on the body 11, such as, for example at upper surface 24 as shown in FIGS. 1, 4, 9A, 9B. In FIGS. 9A and 9B, the openings that communicate between the front surface 22 and rear surface 23 of concrete body 11 can alternatively be diagonal openings 31, 32.

In FIGS. 6 and 8, a concrete body 11 is shown being lifted by a crane 51 having boom 52 and crane lift line 45. The crane 51 can be part of a larger lifting apparatus used in the marine environment such as a derrick barge 47. The derrick barge 47 can carry a plurality of concrete bodies 11. Alternatively, a separate supply barge 48 can be provided carrying a plurality of concrete bodies 11 in order to create a bulkhead as shown in FIGS. 6 and 8. In FIG. 6, crane lift line 45 is shown attached to bridle 44. The bridle 44 connects to a pair of spaced apart lifting eyes 30.

In order to install one or more of the concrete bodies 11, a jetting arrangement has been provided that enables fluid to be pumped through each concrete body 11 during installation. When a concrete body 11 has been lifted by crane 51 and positioned in a desired location as shown in FIG. 8, pumps 49 and manifold 50 on derrick barge 47 can be used to pump fluid under pressure through the hoses of hose bundle 47 to the plurality of inlet fittings 33. Fluid inlet fittings 33 can be placed on the flat upper surface 24 of each concrete body 11. The fluid inlet fittings 33 preferably are quick release type fittings that enable the hoses of hose bundle 46 to be connected and disconnected quickly to a particular concrete body 11 during installation. Once the hose bundle 46 is connected to inlet fittings 33, a series of flow channels is provided internally of concrete body 11 for channeling flow to a number of different flat surfaces of concrete body 11. In the preferred embodiment, these surfaces include bottom surface 17, and the two diagonally extending surfaces 18, 19 of middle tapered section 13. An outlet 35 is provided at each of the surfaces 17, 18, 19 where a flow channel communicates with the surface 17, 18, or 19.

Figure 1:
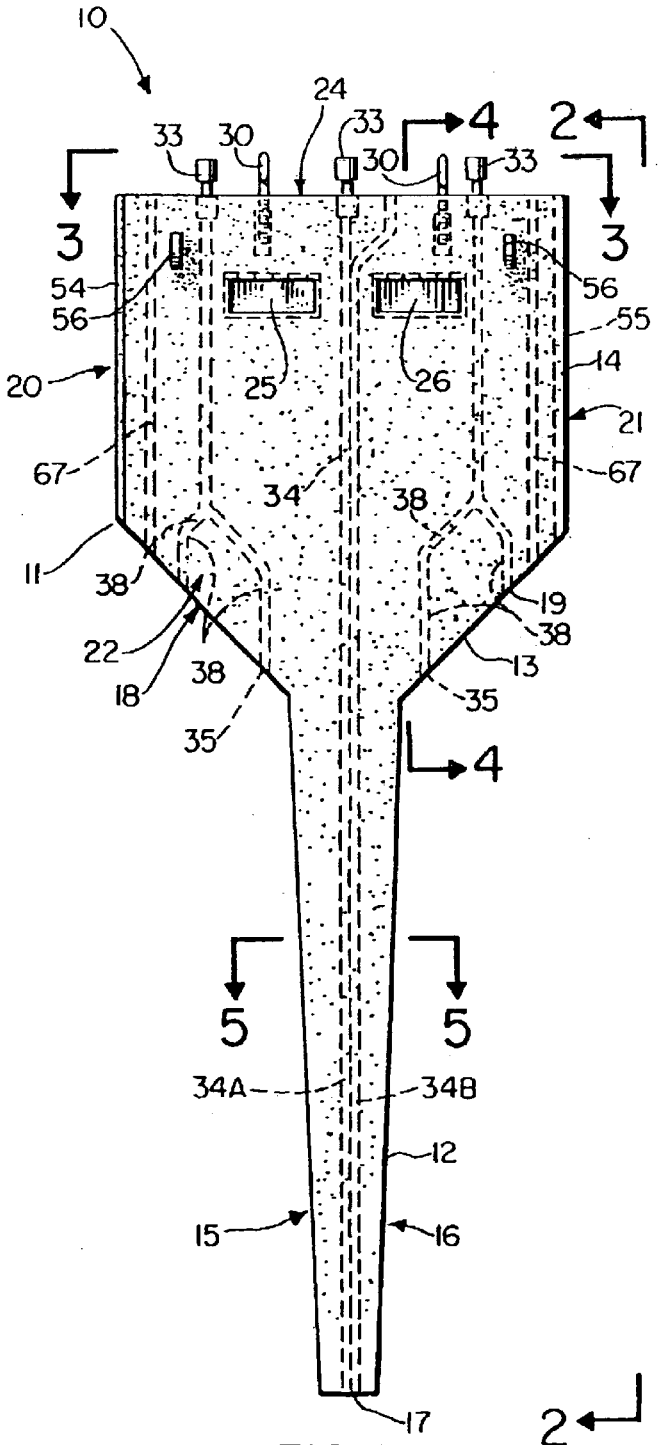
FIG. 1 is a front elevational view of the preferred embodiment of the apparatus of the present invention.
Figure 2:
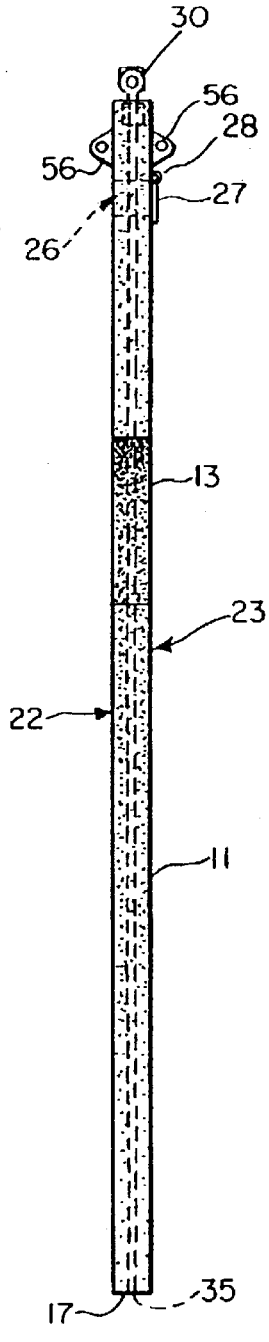
FIG. 2 is a sectional view taken along lines 2—2 of FIG. 1.
Figure 3:
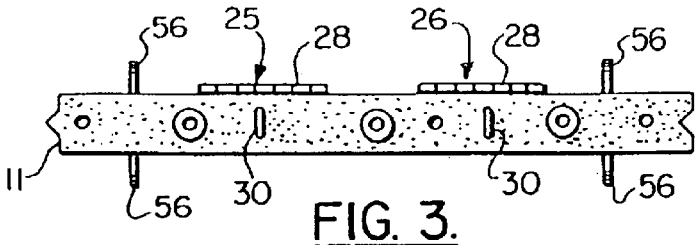
FIG. 3 is a sectional view taken along lines 3—3 of FIG. 1.
Figure 5:
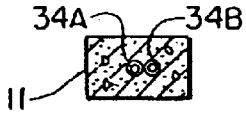
FIG. 5 is a sectional view taken along lines 5—5 of FIG. 1.
Figure 4:
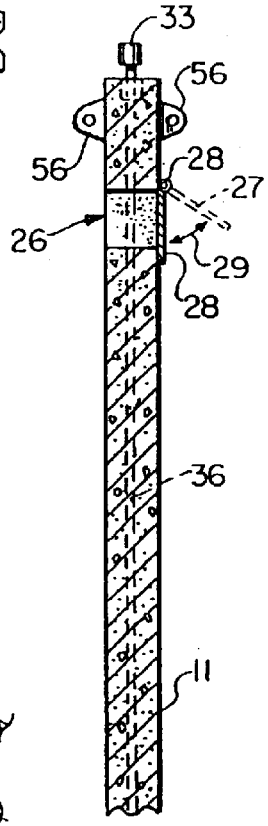
FIG. 4 is a sectional view taken along lines 4—4 of FIG. 1.
Figure 10:
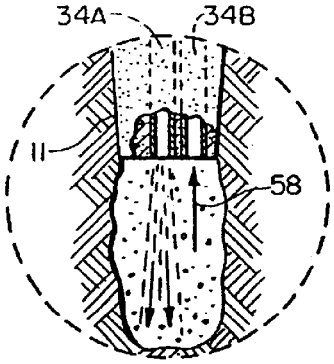
FIG. 10 is a fragmentary view of the preferred embodiment of the apparatus of the present invention showing the lower tip of the apparatus during jetting.
Figure 11:
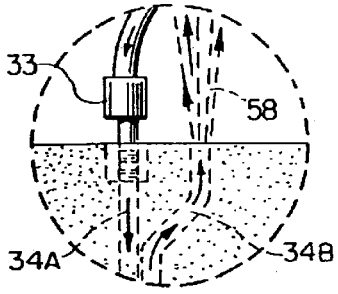
FIG. 11 is a fragmentary view of the preferred embodiment of the apparatus of the present invention showing return flow during jetting.

In FIGS. 1 and 2, the plurality of flow channels can include, for example, a central flow channel 34A, a pair of lateral flow channels 36, and branch channels 38. There can be a return flow path for each flow channel, such as return channel 34B that is positioned next to flow channel 34A. In some situations, it may be necessary to return flow during jetting, as shown by arrows 58 in FIGS. 10–11. The branch channels 38 communicate with wye 37 as shown in FIG. 1. Whereas three inlet fittings 33 are provided in the drawings for adding fluid under pressure to the channels of concrete body 11, five different outlets 35 are provided in the drawings for jetting purposes at bottom surface 17 and at diagonally extending side surfaces 18, 19. These are examples of the number of inlets 33, channels 34 and outlets 35.

During installation, fluid is pumped under pressure through hose bundle 46 to inlet fittings 33 and then into channels 34, 36, 38 as shown in FIG. 6. Arrows 53 in FIG. 6 schematically indicate the direction of fluid flow during installation. This afore described jetting arrangement enables soil to be chewed away from the area to be occupied by a concrete body 11 as shown in FIG. 6.

Each of the concrete bodies 11 can provide a tongue and groove interlocking connection for connecting a plurality of the bodies 11 together as shown in FIG. 6. In FIG. 1, a tongue portion 54 is shown extending vertically along side 20. A groove 55 is shown communicating with vertical sidewall 21. Tongue 54 and groove 55 provide an interlocking connection between the generally vertical sidewalls 20, 21 of adjacent concrete bodies 11 as shown in FIG. 6.

In each of the FIGS. 1–4 and 6–7, a cable anchor can be used to restrain each concrete body 11 from lateral movement during use. The cable anchor can be in the form of a padeye 56 mounted at the upper end portion of each concrete body 11. If desired, padeyes 56 can be placed on both sides, 22 and 23 as shown in FIG. 2 and at spaced apart locations as shown in FIG. 1. Each padeye can have one or more cable anchors 57 attached thereto. Each cable anchor 57 can be of wire rope, for example, and attached to a suitable anchor in the surrounding earth such as for example, piling or a group of piling (not shown).

Figure 12:
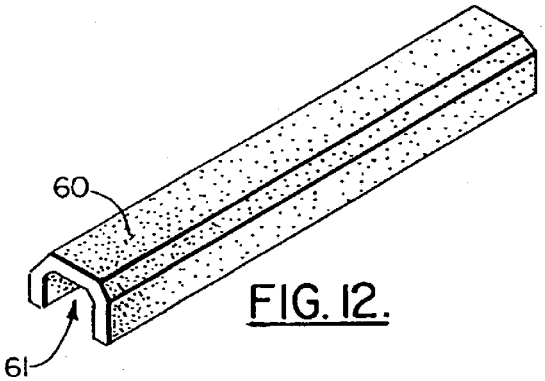
FIG. 12 is a fragmentary view of the preferred embodiment of the apparatus of the present invention showing the horizontal connecting beam.
Figure 13:
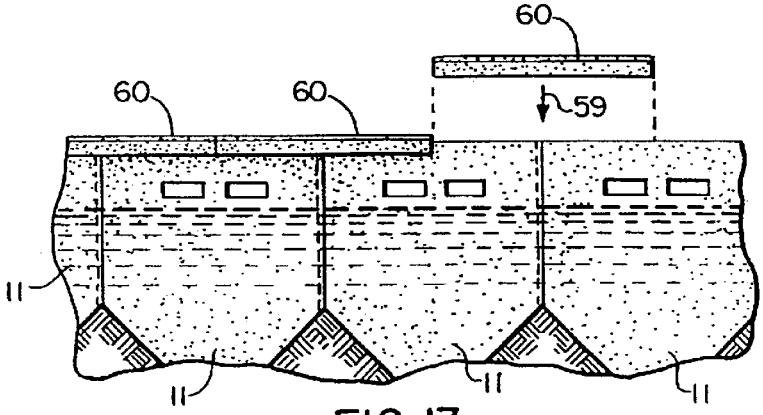
FIG. 13 is an elevational view of the preferred embodiment of the apparatus of the present invention showing installation of the cover beam.

FIGS. 12 and 13 shown a beam 60 that can be used to form a cap or cover to align a plurality of concrete bodies 11 as shown in FIG. 13. Beam 60 provides a recess 61 that fits the upper end portion of each concrete body 11. The beam 60 can be placed at intervals as shown by arrow 59 in FIG. 13.

In FIG. 14, an extension 62 is shown for increasing the overall height of a concrete body 11. Extension 62 provides one or more openings 63 through which water can flow carrying sand or other solid material that will aid in the build up of shoreline. As with the concrete body of FIGS. 1–3 and 9A–9B, the openings can be either straight and linear or diagonally extending as shown in FIG. 9A. For purposes of illustration, extension 62 provides left and right openings 63, 64. A pair of spaced apart vertical rod openings 65 are provided, each receiving a rod 66. Similarly, vertical openings are provided in concrete body 11 for receiving the lower end portion of a rod 66. Vertical openings 67 are receptive or rods 66 as shown in FIGS. 1 and 14.

Figure 15:
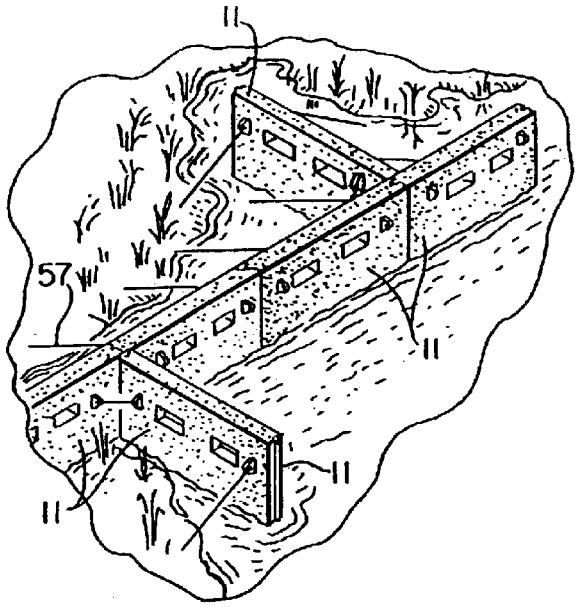
FIG. 15 is a perspective view of the preferred embodiment of the apparatus of the present invention showing a network of perpendicularly arranged concrete bodies.

In FIG. 15, concrete bodies 11 are shown in position wherein some of the concrete bodies form an angle with other concrete bodies. For example, a concrete body can be placed perpendicular to other concrete bodies 11. In 15 as an example, two concrete bodies 11 are shown placed perpendicular to a plurality of four other concrete bodies. In placing such a perpendicularly oriented concrete body 11, the perpendicular body 11 is preferably placed at the tongue and groove 54, 55 joint as shown.

Figure 16:
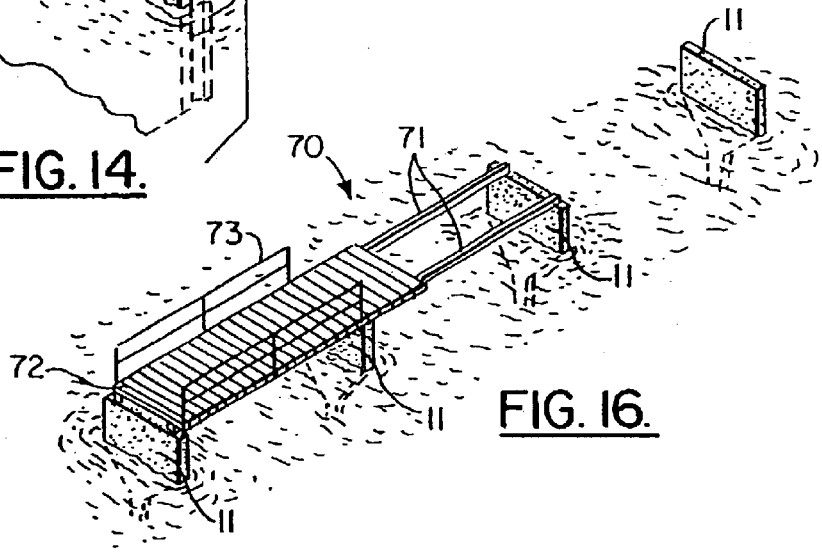
FIG. 16 is a perspective view of a third embodiment of the apparatus of the present invention in the form of a pier or wharf.

In FIG. 16, the concrete bodies 11 are shown in a spaced apart position for the purpose of supporting a pier 70. Pier 70 as shown in FIG. 16 during construction, including four spaced apart concrete bodies 11, a pair of longitudinal beams 71, and decking 72. Hand rails 73 can optionally be provided to decking 72 in order to complete pier 70.

Figure 28:
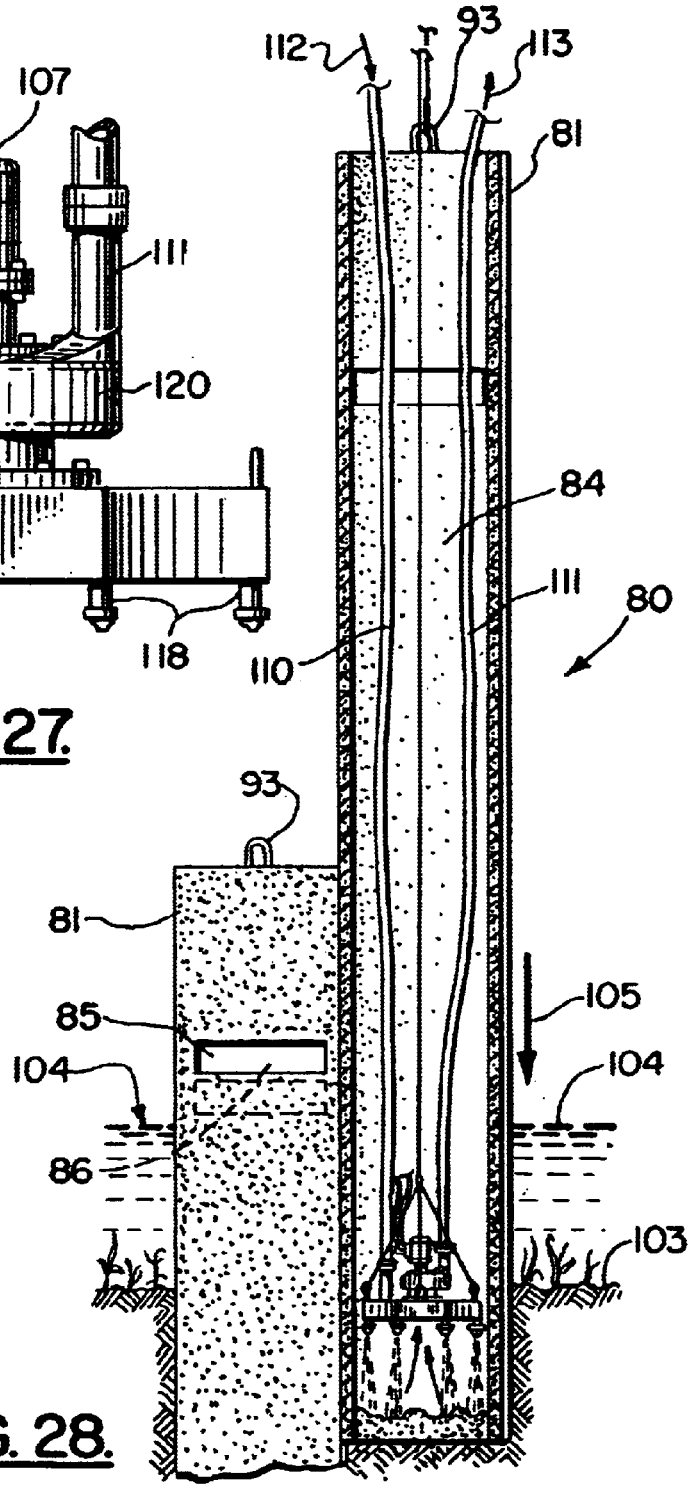
FIG. 28 is a sectional elevation view of the fourth embodiment of the apparatus of the present invention.
Figure 31:
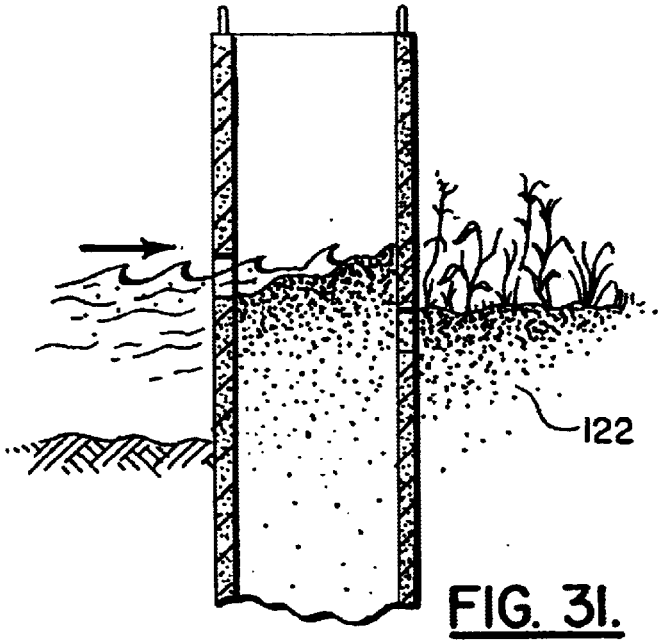
FIG. 31 is a partial elevation view of the preferred embodiment of the apparatus of the present invention showing installation.
Figure 32:
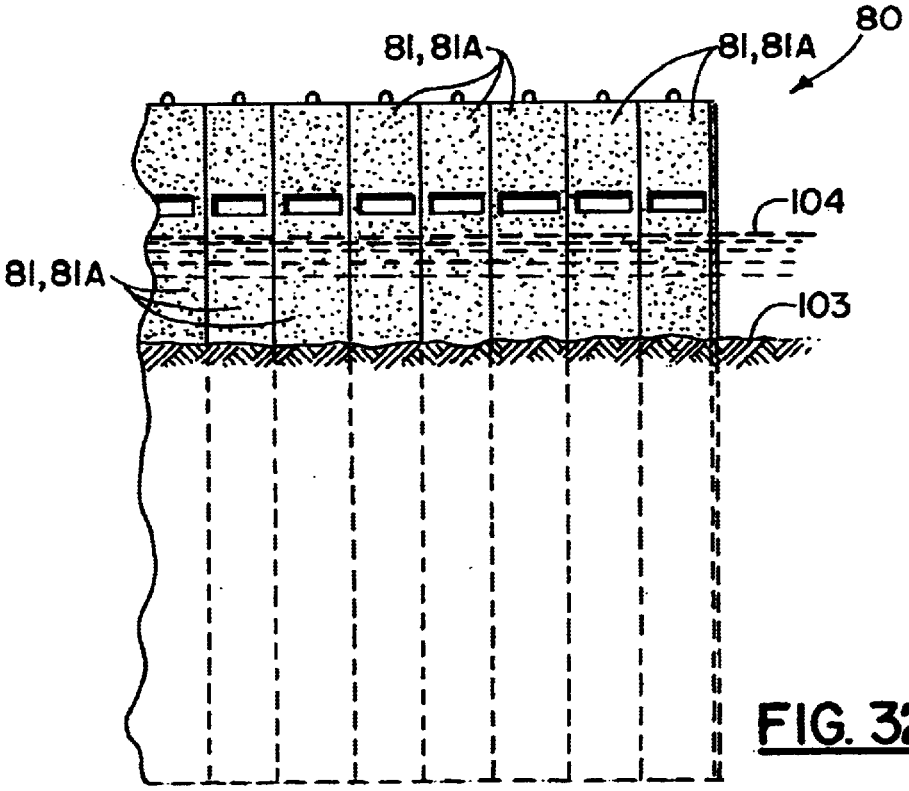
FIG. 32 is an elevation view of the fourth embodiment of the apparatus of the present invention showing an installation of several concrete bodies installed side by side.

The fourth and fifth embodiments of the apparatus of the present invention are shown in FIGS. 17–34. The erosion control system 80 is shown in FIGS. 28 and 32 and include a plurality of concrete bodies 81 or 81A that are installed side by side using a specially configured pump 106 that is shown in FIGS. 23–28 and 33.

Figure 17:
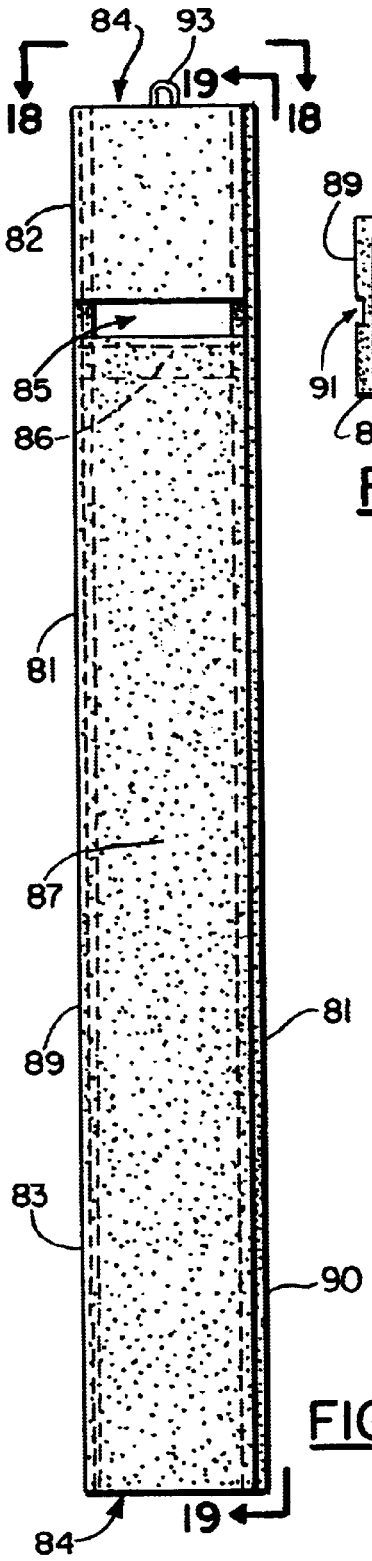
FIG. 17 is a partial front elevation view of a fourth embodiment of the apparatus of the present invention.
Figure 18:
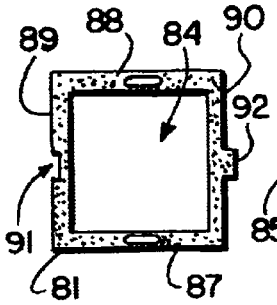
FIG. 18 is a partial sectional view taken along lines 18—18 of FIG. 17.
Figure 19:
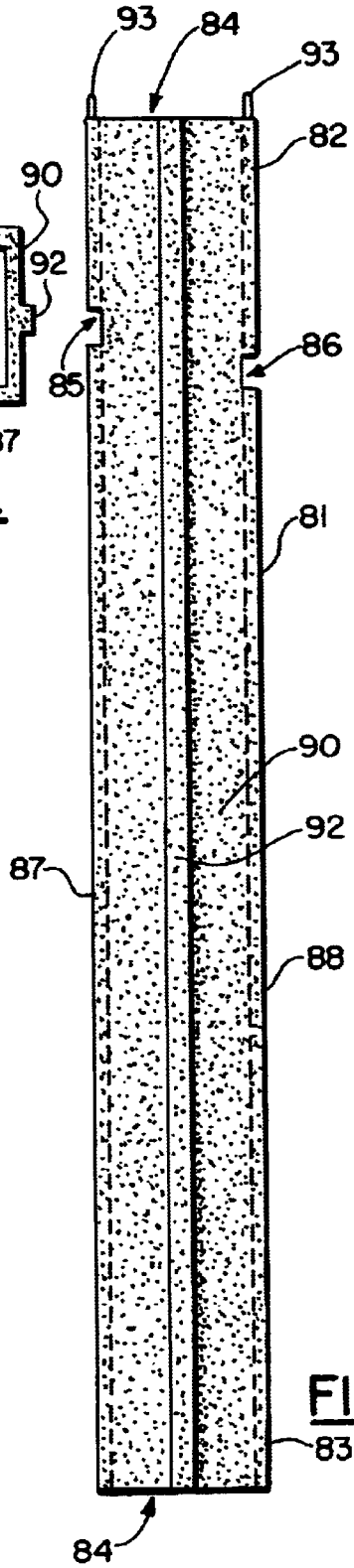
FIG. 19 is a side view of the fourth embodiment of the apparatus of the present invention.
Figure 21:
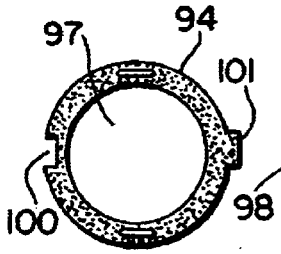
FIG. 21 is a sectional view taken along lines 21—21 of FIG. 20.

Erosion control system 80 employs a concrete body 81 that can be square in transverse cross section as shown in FIG. 18 or circular in transverse cross section as shown in FIG. 21. Concrete body 81 has an upper end portion 82, lower end portion 83, and an open ended vertical bore 84. A front opening 85 communicates with a open ended vertical bore 84. A rear opening 86 is positioned about 180 degrees away from front opening 85 as shown in FIGS. 17 and 19. Concrete body 81 thus has a front wall 87, rear wall 88, left sidewall 89, and right sidewall 90. Vertical groove 91 is provided in left sidewall 89. A vertical rib 92 is provided in right sidewall 90.

One or more lifting eyes 93 can be provided at the upper end portion 82 of concrete body 81.

Figure 20:
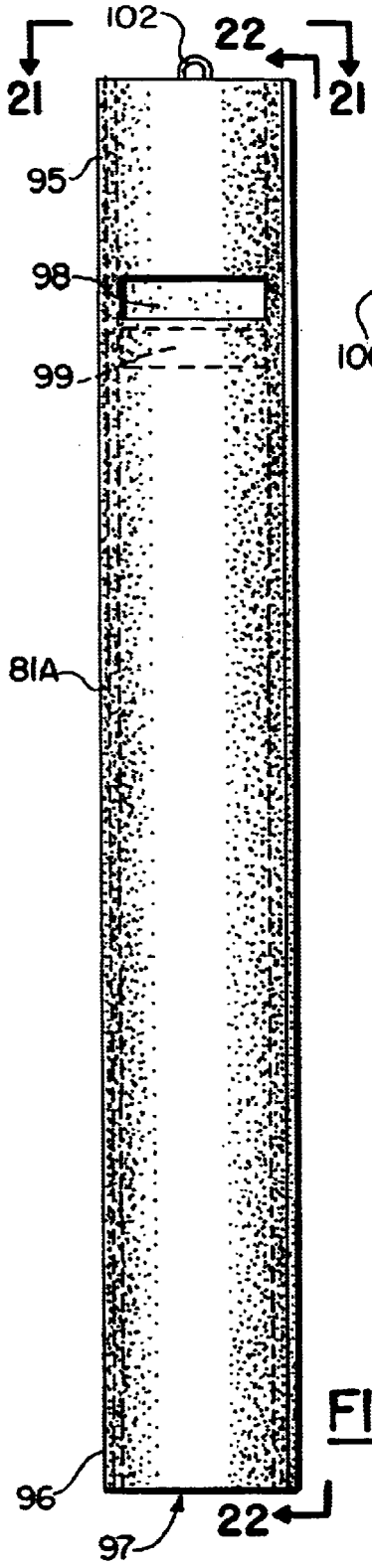
FIG. 20 is a front elevation view of a fifth embodiment of the apparatus of the present invention.
Figure 22:
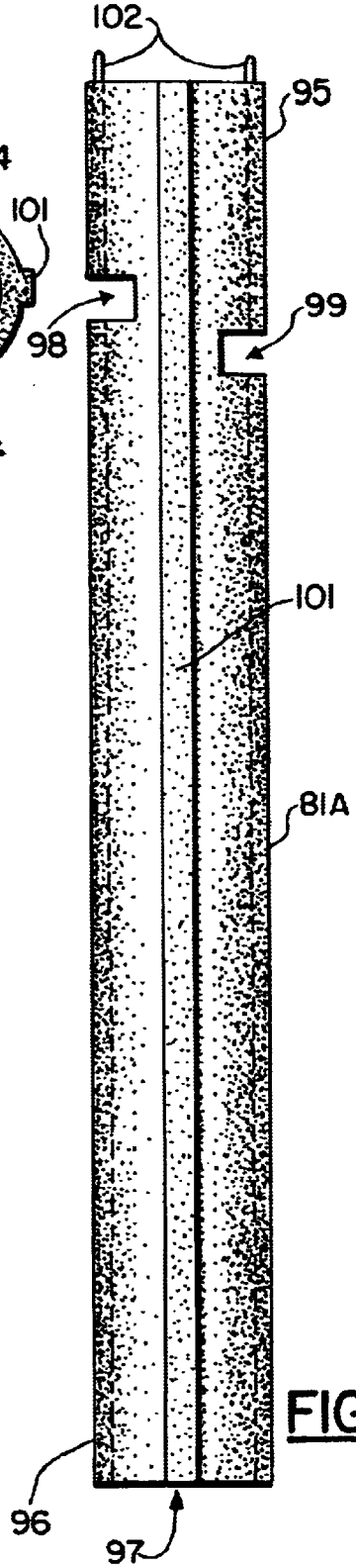
FIG. 22 is a side elevation view illustrating the fifth embodiment of the apparatus of the present invention.
Figure 23:
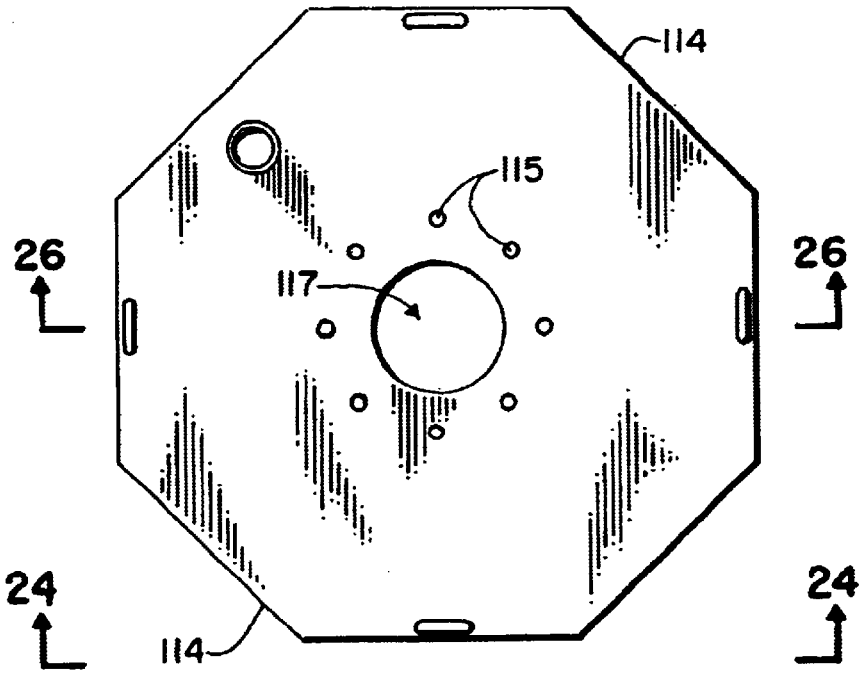
FIG. 23 is a top fragmentary view of the fourth embodiment of the apparatus of the present invention showing the pump portion thereof.
Figure 24:
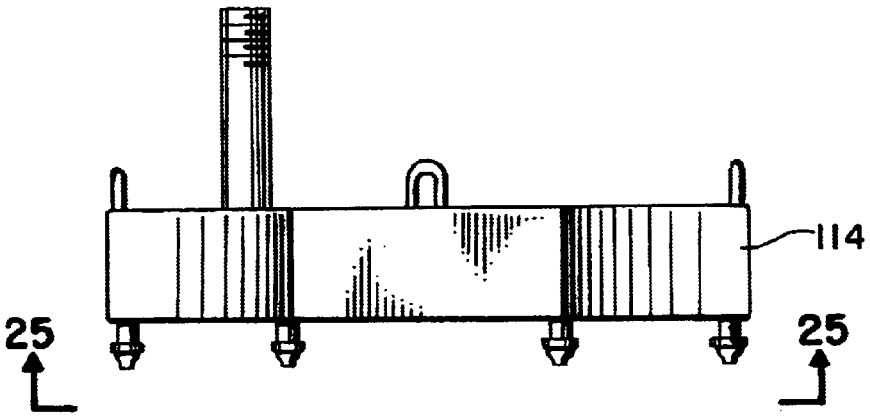
FIG. 24 is a sectional view taken along lines 24—24 of FIG. 23.
Figure 25:
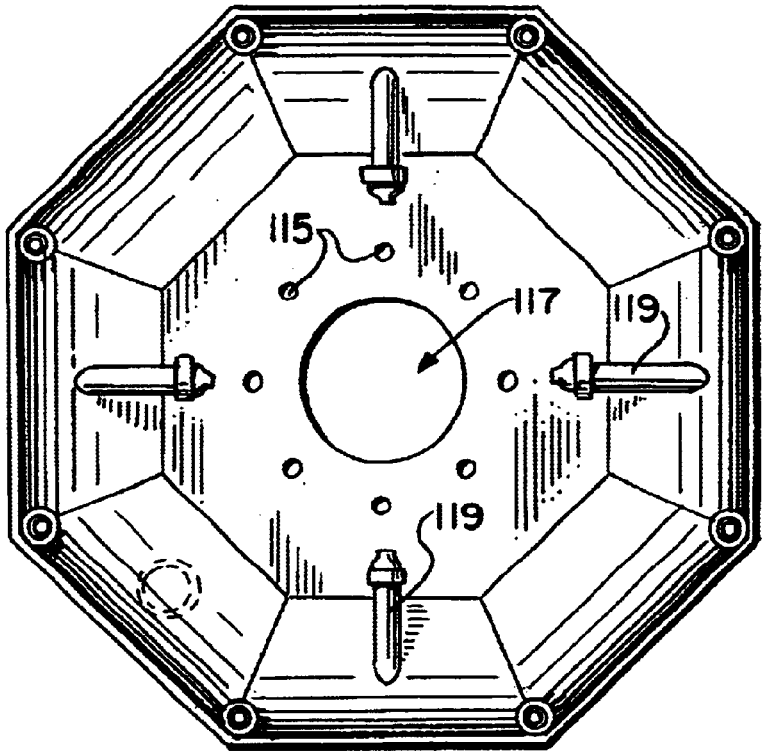
FIG. 25 is a bottom view taken along lines 25—25 of FIG. 24.
Figure 26:
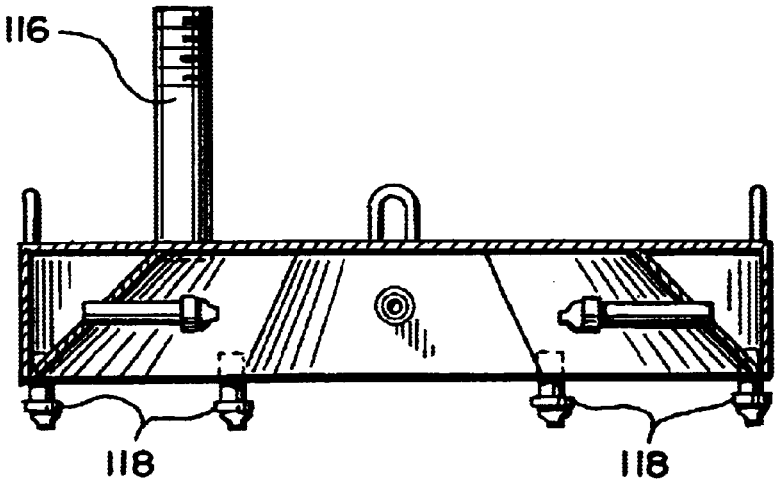
FIG. 26 is a sectional view taken along lines 26—26 of FIG. 23.
Figure 27:
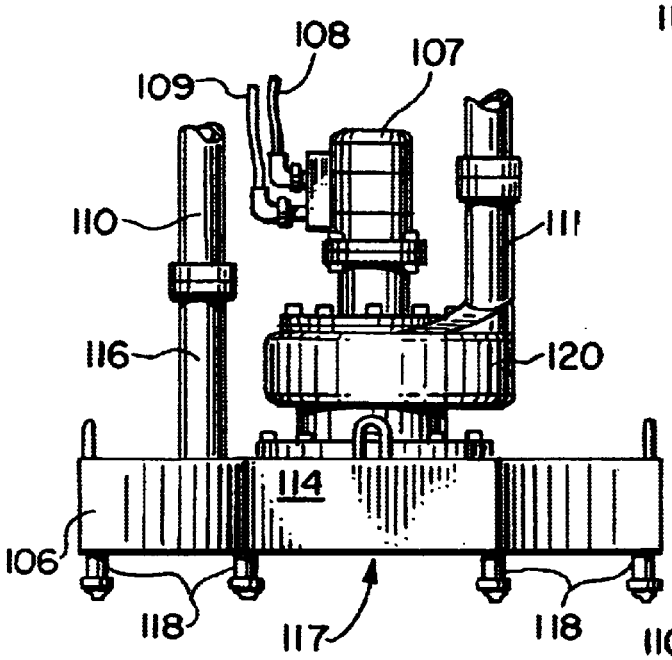
FIG. 27 is a partial elevation view of the fourth embodiment of the apparatus of the present invention.

A fifth embodiment shown in FIGS. 20–22 provides a concrete body 81 that is tubular in shape, having a cylindrically shaped wall 94, upper end 95 and lower end 96.

Concrete body 81A has an open ended vertical bore 97.

Front opening 98 is spaced about 180 degrees apart from rear opening 99. The front opening 98 is preferably at a higher elevational position than the rear opening 99 as shown in FIG. 22.

A vertical groove 100 is provided in the outer surface of cylindrical wall 94. A vertical rib 101 is spaced about 180 degrees away from the vertical groove 100 as shown in FIGS. 20–22.

Tubular concrete body 81A can be provided with a plurality of lifting eyes 102 that enable it to be lifted by a crane or other lifting device during installation or removal.

As with the embodiment of FIGS. 17–19, the tubular concrete body 81A of FIGS. 20–22 can be installed using pump 106 that is shown in FIGS. 23–27. In FIG. 28, a concrete body 81 or 81A is shown being installed using pump 106 to define the erosion control system 80. A selected concrete body 81 or 81A is installed in water bottom 103, embedded so that openings 85, 86, 98, 99 are just above water surface 104.

In FIG. 28, arrow 105 schematically illustrates the lowering of a selected concrete body 81 or 81A into seabed 103 using pump 106 to jet away a material that is under the concrete body 81 or 81A.

In FIGS. 23–28, pump 106 is preferably hydraulically powered, provided hydraulic motor 107 and hydraulic flow lines 108, 109 for supplying pressurized hydraulic fluid to hydraulic motor 107. Hydraulic motor 107 drives a pump impeller section 120. When the hydraulic motor is operated, material that is dislodged using jets 118, 119 can be pumped away via discharge flow line 111.

Jets 118, 119, include vertical jets 118 and horizontal jets 119. Flow line 110 carries pressurized fluid such as pressurized water to jets 118, 119 via pipe joint 116. Suction inlet 117 intakes dislodged sediment that is cut away from seabed 103 using jets 118, 119. Arrow 112 in FIG. 28 illustrates the flow of pressurized water in line 110 to pipe joint 116 and jets 118, 119. Arrow 113 illustrates the discharge of sediment to a selected location as it flows through pump discharge line 111.

Pump 106 has a pump body 114 to which impeller section 120 is bolted as shown in FIGS. 23–28. Openings 115 are provided in pump body 114 for enabling a bolted connection to be made between impeller section 120 and pump body 114. Opening 117 in pump body 114 is an intake opening that aligns with the intake of impeller section 120, a commercially available hydraulically operated pump.

When in use, a crane or the lifting device can be used to raise and lower each selected concrete body 81 or 81A and put it in a selected position along a shoreline or bank to be protected. As shown in FIG. 32, the concrete bodies 81 or 81A are positioned side by side with a projecting rib 92 or 101 of one of the concrete bodies engaging a longitudinally extending or vertical groove 91 or 100 of an adjacent concrete body 81 or 81A. Once a concrete body is lowered by a crane or other lifting device that engages the lifting eyes 93 or 102 of the selected concrete body 81 or 81A, pump 106 is placed in the vertically extending open ended bore 84 or 97 and lowered to the seabed 103. As shown in FIG. 28, operation of the pump includes a cutting of the seabed using the jets 118, 119 and a simultaneous pumping away of cuttings using hydraulic motor 107 and impeller section 120 of pump 106. As the material is removed, the selected concrete body 81 or 81A simply sinks into the opening that is created by the pump 106 and is lowered to a selected elevation.

Figure 30:
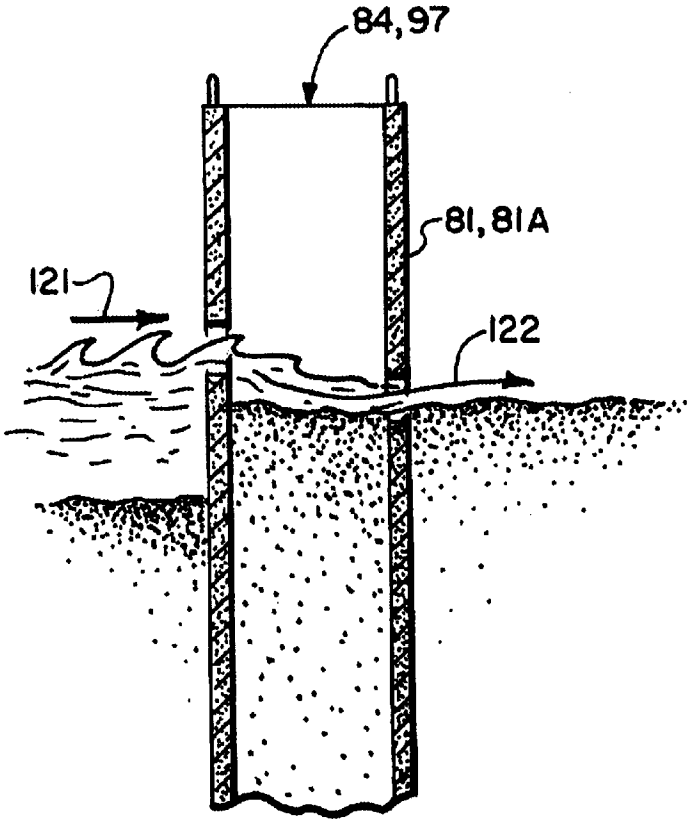
FIG. 30 is a partial elevation view of the fourth embodiment of the apparatus of the present invention showing installation.
Figure 29:
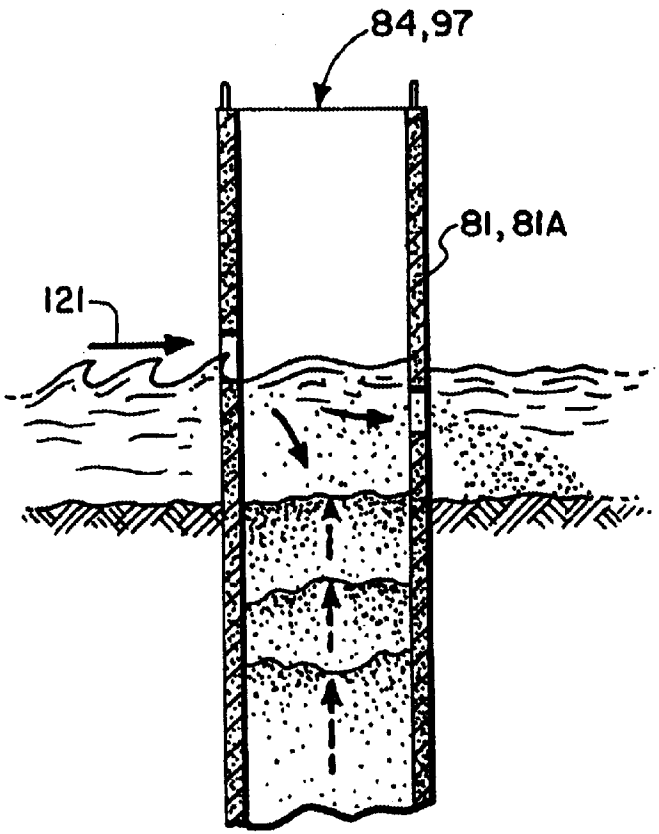
FIG. 29 is a partial elevation view of the fourth embodiment of the apparatus of the present invention showing installation.

FIGS. 29–30 illustrate the buildup of sediment inside of the selected concrete body 81 or 81A over time. As wave action illustrated schematically by arrow 121 in FIGS. 29 and 30 engages the concrete bodies 81, 81A, material carried by the waves enters the front opening 85 or 98 and is trapped within the vertical bore 84 or 97. Rear opening 86 or 99 of each concrete body 81 or 81A enables some water to flow completely through as illustrated by the arrow 122 in FIG. 30. However, some sediment carried by the wave action will remain within bore 84 or 97 and settle until the entire bore 84, 97 is filled with sediment up to the level of the front opening 85 or 98 as illustrated in FIG. 31. At this point, water is unable to pass completely through from the front opening 85 or 98 to the rear opening 86 or 99 of the selected concrete body 81 or 81A. This new buildup of sediment is illustrated by the arrow 122 in FIG. 31.

Figure 33:
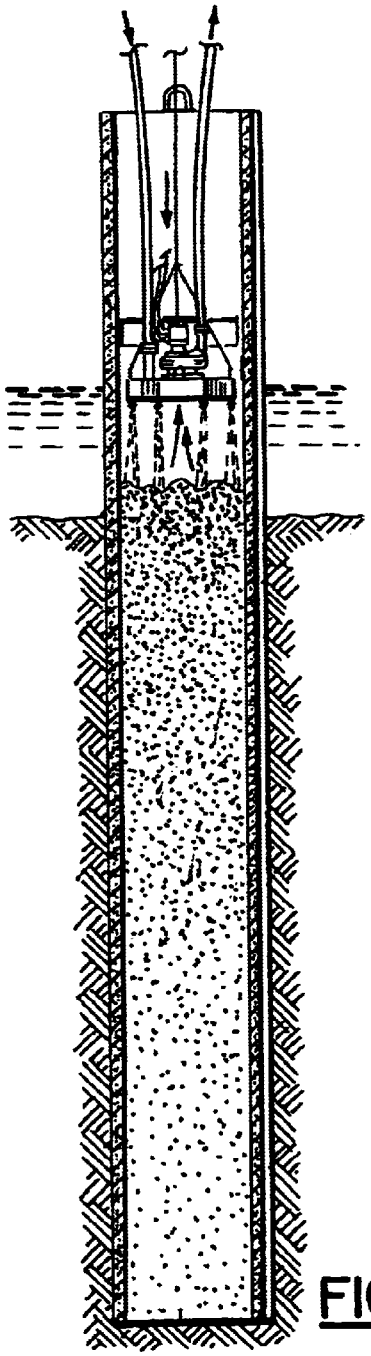
FIGS. 33–34 are sectional elevation views of the fourth embodiment of the apparatus of the present invention illustrating removal of a concrete body for transport to a new location.
Figure 34:
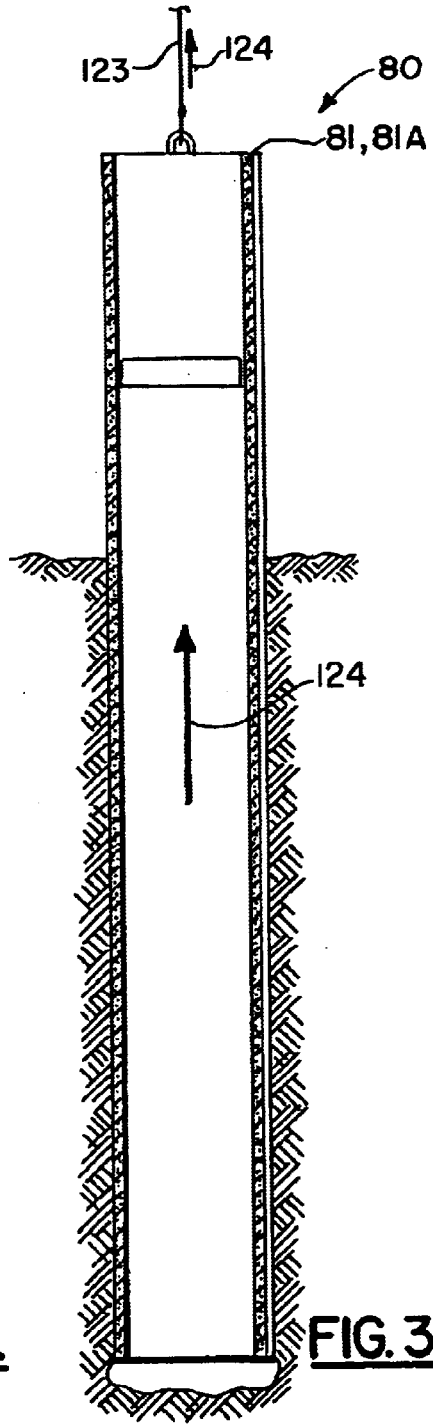

If an owner wants to move a concrete body 81 or 81A, the pump 106 can be used to jet away sediment that has accumulated within the bore 84 or 97 of the selected concrete body 81 or 81A as shown in FIGS. 33 and 34. A lifting line 123 of a crane, dragline or the like can then remove the selected concrete body 81 or 81A as illustrated by the arrow 124 in FIG. 34 and transport it to a new location.

PARTS LIST

| Parts Number | Description |
|---|---|
| 10 | erosion control apparatus |
| 11 | concrete body |
| 12 | lower tapered section |
| 13 | middle tapered section |
| 14 | upper rectangular section |
| 15 | angled sidewall |
| 16 | angled sidewall |
| 17 | bottom surface |
| 18 | diagonal sidewall |
| 19 | diagonal sidewall |
| 20 | vertical sidewall |
| 21 | vertical sidewall |
| 22 | front surface |
| 23 | rear surface |
| 21 | flat upper surface |
| 25 | opening |
| 26 | opening |
| 27 | plate |
| 28 | hinge |
| 29 | arrow |
| 30 | lifting eye |
| 31 | diagonal opening |
| 32 | diagonal opening |
| 33 | inlet fitting |
| 34A | central flow channel |
| 34B | central return channel |
| 35 | outlet |
| 36 | lateral flow channel |
| 37 | wye |
| 38 | branch channei |
| 39 | Seabed |
| 40 | water surface |
| 41 | New accretions |
| 42 | arrow |
| 43 | arrow |
| 44 | bridle |
| 45 | crane lift line |
| 46 | bose bundle |
| 47 | derrick barge |
| 48 | supply barge |
| 49 | pump |
| 50 | manifold |
| 51 | crane |
| 52 | boorn |
| 53 | arrow |
| 54 | tongue |
| 55 | groove |
| 56 | padeye |
| 57 | cable anchor |
| 58 | arrow |
| 59 | arrow |
| 60 | beam |
| 61 | recess |
| 62 | extension |
| 63 | opening |
| 64 | opening |

-continued

PARTS LIST

| Parts Number | Description |
|---|---|
| 65 | rod opening |
| 66 | rod |
| 67 | vertical rod opening |
| 70 | pier |
| 71 | longitudinal beams |
| 72 | decking |
| 73 | hand rail |
| 74 | reference line |
| 75 | reference line |
| 76 | soil and/or sand mass |
| 80 | erosion control system |
| 81 | concrete body |
| 81A | concrete body |
| 82 | upper end |
| 83 | lower end |
| 84 | open ended vertical bore |
| 85 | front opening |
| 86 | rear opening |
| 87 | front wall |
| 88 | rear wall |
| 89 | left sidewall |
| 90 | right sidewall |
| 91 | vertical groove |
| 92 | vertical rib |
| 93 | lifting eye |
| 94 | cylindrical wall |
| 95 | upper end |
| 96 | lower end |
| 97 | open ended vertical bore |
| 98 | front opening |
| 99 | rear opening |
| 100 | vertical groove |
| 101 | vertical rib |
| 102 | lifting eye |
| 103 | water bottom |
| 104 | water's surface |
| 105 | arrow |
| 106 | pump |
| 107 | hydraulic motor |
| 108 | hydraulic flow line |
| 109 | hydraulic flow line |
| 110 | flow iine |
| 111 | pump discharge |
| 112 | arrow |
| 113 | arrow |
| 114 | purnp body |
| 115 | opening |
| 116 | pipe joint |
| 117 | suction inlet |
| 118 | vertical jet |
| 119 | horizontal jet |
| 120 | impeller section |
| 121 | arrow |
| 122 | sediment |
| 123 | lift line |
| 124 | arrow |

The foregoing embodiments are presented by way of example only; the scope of the present invention is to be limited only by the following claims.

What is claimed is:

1. A method of erosion control for controlling erosion at a shoreline next to a seabed, comprising the steps of:

a) placing a plurality of concrete bodies along a shoreline to be protected from erosion, wherein each concrete body is closely positioned to an adjacent concrete body, each of the concrete bodies comprising a tubular section having upper and lower end portions, a height, a width, a vertical open ended bore, and a pair of opposed openings that are in between the upper and lower end portions of each concrete body;

b) positioning each of the concrete bodies into a partially embedded position with a jetting pump that occupies the vertical bore and that places the lower end portion of each concrete body in the seabed and at least part above the seabed, and wherein at least one of the opposed openings are above the seabed so that water can flow into the bore via one of the openings.

2. The method of claim 1 further comprising the step of positioning the opposed openings in each concrete body at different elevations.

3. The method of claim 1 further comprising the step of providing the opposed openings in each concrete body about 180 degrees apart.

4. The method of claim 1 wherein in step "b" the pump simultaneously jets the seabed and pumps cuttings from the bore.

5. The method of claim 4 further comprising the step of jetting in multiple directions during installation.

6. The method of claim 1 wherein the concrete body has front and rear opposed openings extending through the concrete body that communicate with jetting outlets at diagonally extending surfaces, and further comprising the step of jetting the diagonally extending surfaces at the jetting outlets during installation.

7. The method of claim 1 wherein each concrete body has a uniform width.

8. The method of claim 1 further comprising embedding most of the concrete body in the seabed.

9. The method of claim 1 wherein at least some of the concrete bodies have a rectangular transverse cross section.

10. The method of claim 1 wherein at least one of the concrete bodies has a curved side wall.

11. A method of erosion control for controlling erosion at a shoreline next to a seabed, comprising the steps of:

a) placing a plurality of concrete bodies along a shoreline to be protected from erosion, each of the concrete bodies having an upper and lower parts, a generally uniform transverse cross section, the upper part having a front opening, a rear opening and a central bore;

b) pumping material from the seabed below each concrete body with a jetting pump that occupies the bore, the pump and concrete body lowering in elevation as material is pumped;

c) lowering each concrete body into the seabed to bury only a lower part of each concrete body, an upper part being surrounded by water that communicates with the front and rear end openings;

d) wherein each concrete body is closely positioned to an adjacent concrete body by abutting a side of one concrete body with the side of another of said concrete bodies; and e) allowing sediment to enter the bore via one or both of the openings as wave action carries water from the front opening to the rear opening.

* * * * *